United States Patent [19]

Yunan

[11] Patent Number: 4,722,279

[45] Date of Patent: Feb. 2, 1988

[54] NON-ELECTRIC DETONATORS WITHOUT A PERCUSSION ELEMENT

[75] Inventor: Malak E. Yunan, Boonton Township, Boonton County, N.J.

[73] Assignee: E. I. Du Pont de Nemours and Company, Wilmington, Del.

[21] Appl. No.: 931,079

[22] Filed: Nov. 17, 1986

[51] Int. Cl.[4] ..... C06C 5/00; F41B 3/10

[52] U.S. Cl. ..... 102/275.4; 102/275.7

[58] Field of Search ..... 102/275.4, 275.2, 275.3, 102/275.4, 275.7, 275.12, 204, 205, 200

[56] References Cited

U.S. PATENT DOCUMENTS

| | | | |
|---|---|---|---|
| 4,248,152 | 2/1981 | Yunan | 102/275.4 |
| 4,335,652 | 6/1982 | Bryan | 102/275.3 X |
| 4,424,747 | 1/1984 | Yunan | 102/275.3 X |
| 4,426,933 | 1/1984 | Yunan | 102/275.3 |
| 4,429,632 | 2/1984 | Yunan | 102/202.13 |
| 4,495,867 | 1/1985 | Mitchell et al. | 102/275.4 |
| 4,539,909 | 9/1985 | Day et al. | 102/275.2 |

*Primary Examiner*—David H. Brown

*Attorney, Agent, or Firm*—Hilmar L. Fricke

[57] ABSTRACT

A non-electric detonator device having a tubular shell that is closed at its bottom end and containing a base charge of a detonating explosive at the bottom of the shell, a priming charge of a heat sensitive detonating explosive composition adjacent to the base charge, a rupturable membrane that seals the top end of the shell and forms an open volume between the priming charge and the top end of the shell and a holder for holding a low energy detonating cord (LEDC) in abutting relationship to the membrane:

whereby on detonation of the LEDC the membrane is ruptured and the priming charge is initiated which in turn initiates the detonating explosive.

20 Claims, 32 Drawing Figures

NON-ELECTRIC DETONATORS WITHOUT A PERCUSSION ELEMENT

BACKGROUND OF THE INVENTION

This invention relates to a non-electric detonator for explosives and in particular to a non-electric detonator that does not contain a percussion element.

The safety of blasting operations has been greatly improved by the use of non-electric detonators actuated by a low energy detonating cord (LEDC). Typical non-electric detonators and assemblies using these detonators and LEDC lines are shown in Yunan U.S. Pat. No. 4,426,933 issued Jan. 24, 1984, Mitchell, Jr. et al. U.S. Pat. No. 4,495,867 issued Jan. 29, 1985, Day et al. U.S. Pat. No. 4,539,909 issued Sept. 10, 1985, Bryan U.S. Pat. No. 4,335,652 issued June 22, 1982, Yunan U.S. Pat. No. 4,424,747 issued Jan. 10, 1984, Yunan U.S. Pat. No. 4,248,152 issued Feb. 3, 1981, and Yunan U.S. Pat. No. 4,429,632 issued Nov. 11, 1980. However, these non-electric detonators require intimate contact between the LEDC, the percussion element or shell containing a layer of a sensitive explosive material. Such structures work on shock transmission either to initiate the sensitive explosive or to pinch the powder in the percussion element against an anvil or rim. These detonators with either a percussion element or a shock sensitive explosive contained in a shell may fail to initiate the detonator due to poor cord to element contact and may under some circumstances be accidentally triggered to set of the explosive charge. To further improve the safety of detonators, it would be desirable to either eliminate the percussion element or conceal and protect the sensitive explosive in a plastic body. This invention makes possible the design of a detonator without a percussion element or without an exposed portion of a shell containing a sensitive explosive for use with a LEDC that would consistently fire and be reliable for use in a blasting assembly.

SUMMARY OF THE INVENTION

A non-electric detonator device comprising a tubular shell closed at its bottom end and having (a) at least one base charge of a detonating explosive composition located in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell and (d) means for holding low energy detonating cord (LEDC) positioned in abutting relationship to the membrane;

whereby on detonation of the LEDC the membrane is ruptured and the priming charge is initiated which in turn initiates the detonating explosive.

Included in this invention is an assembly of the detonator device, LDEC and an explosive charge.

BRIEF DESCRIPTION OF THE DRAWINGS

FIGS. 10A and 10B show the detonator device position in explosive charges.

DETAILED DESCRIPTION OF THE INVENTION

The present invention is based on the discovery that intimate contact between detonating cord and percussion element or a shell containing a shock sensitive explosive is not required for a reliable non-electric detonator that uses a LEDC, i.e. a cord having a pentaerythritol tetranitrate (PETN) core loading of about 0.10–2 grams per meter. The detonators of this invention have a high level of reliability for firing. Since the detonator does not contain a percussion element or a shock sensitive explosive in the exposed portion of the shell, it is inherently safer to handle and premature triggering of an explosive charge is practically eliminated.

Figure 1:
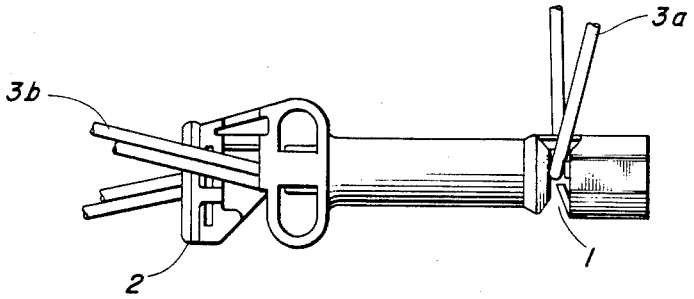
FIG. 1 shows a side view of the detonator device.

FIG. 1 shows a side view of the molded plastic body that holds the detonator that has a fixed slot 1 for attaching the input or initiating LEDC 3*a* and another fixed holder 2 for attaching two output LEDC 3*b* that are to be initiated by explosives in the detonator. The body is plastic such as polyethylene or polypropylene. Thermosetting plastics such as molded rubber compounds like styrene/butadiene rubber can also be used. The tubular shell containing the explosive components is positioned in this body, as shown in detail in FIG. 2.

Figure 2:
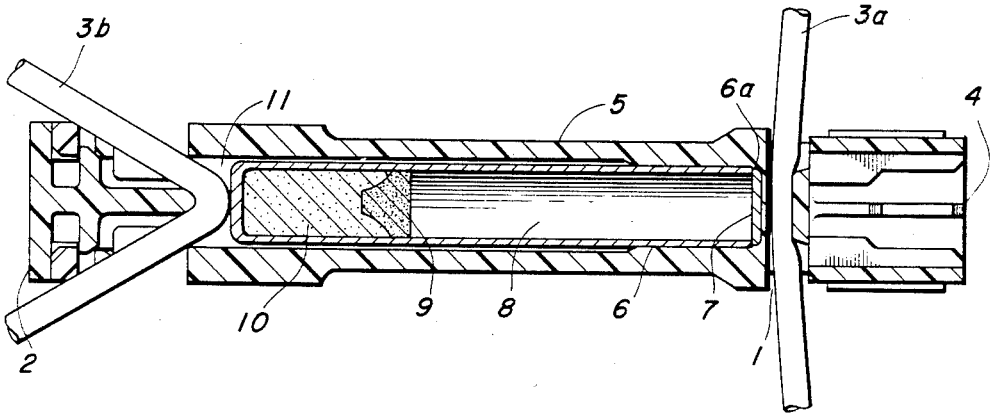
FIG. 2 shows a cross section of the detonator device of FIG. 1 with a straight cord to membrane contact.

FIG. 2 is a cross section of FIG. 1. The cross section of the fixed slot 1 which holds the input LEDC 3*a* is shown and its relation to the main portion 5 of the plastic body. The input end 4 of the plastic body is a cavity designed to accept and secure different diameter electric or non-electric initiating devices, which when fired rupture membrane 7 and initiate the primer charge 9. Shell 6, usually metal and preferably aluminum is positioned in the body 5 through opening 11 and held in place by a friction fit. Hinge 2 is closed and becomes fixed to hold output LEDC 3*b* in place. The shell contains in its base a detonating explosive 10, also known as the base charge. Typical base charges that can be used are pentaerythritol tetranitrate (PETN), cyclotrimethylene trinitramine, cyclotetramethylene tetranitramine, lead azide, picrylsulfone, nitromannite, trinitrotoluene (TNT) and the like. Covering the base charge is a priming charge 9 that can be flat or tapered and imbedded in the base charge or detonating explosive. Typical priming charges are of lead azide, lead styphnate, diazodinitrophenol, mercury fulminate and nitromannite. Mixtures of diazodinitrophenol/potassium chlorate, nitromannite/diazodinitrophenol and lead azide/lead styphnate also can be used. A separate layer of lead styphnate or a layer of a mixture of lead styphnate can be placed over lead azide.

The top of the shell 6a generally is slightly round to facilitate its insertion and is sealed with a rupturable membrane 7 that ruptures when the LEDC is ignited.

A U or V shaped LEDC cord configuration may be used for either or both ends of the detonator to penetrate a thicker membrane or ignite a less sensitive powder. This type of configuration is shown in Yunan U.S. Pat. No. 4,424,747 issued Jan. 10, 1984.

The open space between the priming charge 9 and the rupturable membrane 7 is represented by 8 and is a distance of about 1/32–11 inches, preferably about ½–2½ inches is used for an instantaneous charge. If a delay charge or an ignition powder is used, 1/32–½ of an inch is preferred. It is known that slower burning rates of delay powders can be obtained by increasing the open space 8. Means to quickly pressurize and improve timing of delay detonators with enclosed open space are discussed in the aforementioned Yunan U.S. Pat. No. 4,429,632.

Shorter open space distances are normally preferred between the membrane and the explosive charge. However, under some circumstances a long tube or shell up to ten inches in length, similar in arrangement to FIG. 3, may be needed to pass the shock from the LEDC cord through sensitive surroundings such as electrical components or connectors which could be damaged by a shock wave from either the LEDC or the explosive charge but which of course may be easily isolated by containing the output of the explosive using insulating material in available space.

Figure 3:
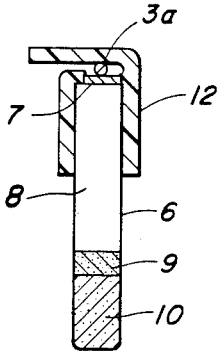
FIG. 3 shows cross section of a detonator device having different input cord attachment.

FIG. 3 shows cross section of a LEDC cord holder containing LEDC cord 3a attached to shell 6 containing the detonating base explosive 10 and the priming charge 9 positioned flatly against the base explosive. A plastic LEDC holder 12 having a fixed slot is positioned over the end of the shell containing the rupturable membrane 7 and there is an open space 8 between the priming charge and the rupturable membrane. Such a device can be used to initiate other explosive devices. The holder 12 can be designed to accept more than one LEDC.

Figure 4A:
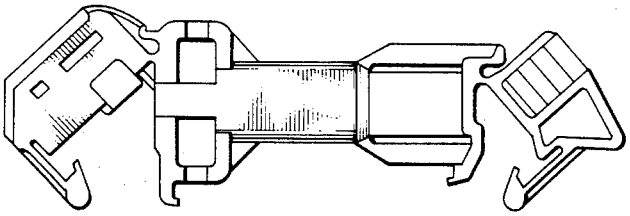
FIG. 4 A shows a side view of the detonator with hinged LEDC holding devices, FIG. 4 B shows a cross section of FIG. 4 A, in closed position and FIG. 4 C shows a cross section of a detonator with fixed LEDC holding devices.
Figure 4B:
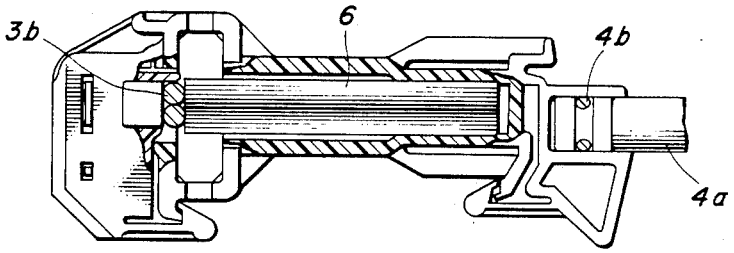
Figure 4C:
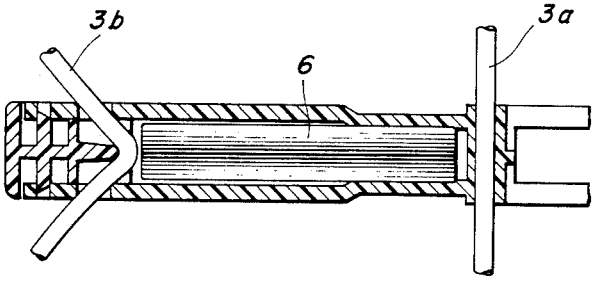

FIG. 4 A shows a plastic holder for the shell having two hinged holders for the LEDC. FIG. 4 B shows a cross section of the plastic holder having an electric or non-electric detonator 4a or high energy detonating cord positioned in cavity 4b and a shell 6 positioned in the body of the plastic holder and two output LEDC 3b held by the hinged holder. Shell 6 is shown empty and may be any one of the shells shown in FIGS. 8 and 9. FIG. 4 C shows the cross section of a plastic holder having fixed LEDC holders on either end containing LEDC 3a and 3b and a shell 6 positioned in the holder.

Figure 5A:
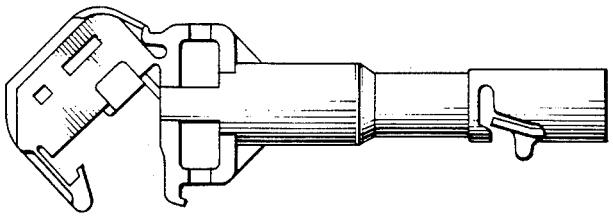
FIG. 5 A shows a side view of a detonator with one hinged and another fixed LEDC holding device and FIG. 5 B show a cross section of FIG. 5 A in closed position.
Figure 5B:
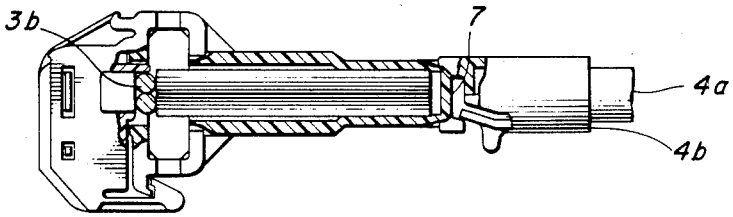

FIG. 5 A shows a side view of a plastic holder having one hinged holder for one or two output LEDC and a fixed holder for input LEDC. FIG. 5 B shows a cross section of FIG. 5 A in which an initiator 4a is positioned in the cavity 4b. The initiator may be an electric or non-electric detonator or a high energy detonating cord which when fired shatters the membrane 7 and ignites the explosives in the shell 6. Two output LEDCs 3b are held in place by the hinged holder.

Figure 6:
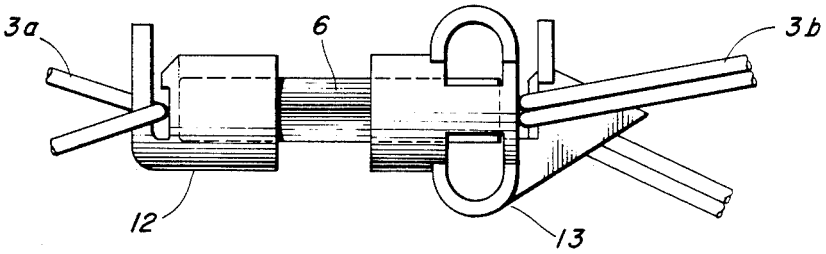
FIG. 6 shows a side view of the detonator device with push-on LEDC holding devices on both ends of the detonator.

FIG. 6 shows a shell 6 having a fixed plastic holder 12 for the input LEDC 3a and another fixed plastic holder 13 for the output LEDC 3b separate from holder 12 which gives the freedom of using any length shell. The two part plastic body shown in FIG. 6 is not restricted to holders 12 or 13 but may be any of the aforementioned holder designs.

U.S. Pat. No. 4,426,933 shows a connector that fits over a shell. This connector which can be made of plastic or metal may be made with a rupturable membrane and made to fit inside the shell or over the shell.

Figure 7A:
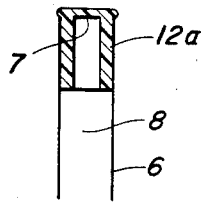
FIG. 7 A and B show a different type of cap with a rupturable membrane sealing the open end of a shell.

The rupturable membrane may be part of the plastic connector as shown previously or may be part of a cap needed to seal the shell as shown in FIGS. 7A and B. The sealed shell with its own rupturable membrane may then be inserted in any of the previously described connectors, without a rupturable membrane to give the same performance.

Figure 7B:
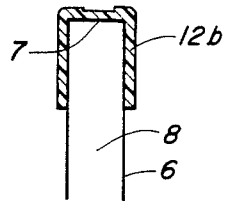
Figure 8A:
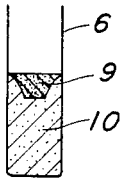
FIG. 8 A through I show cross sections of shells with different instantaneous explosive loadings that can be used to form the detonator device of this invention.
Figure 8B:
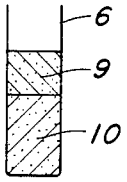
Figure 8C:
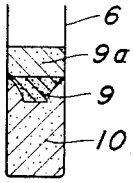
Figure 8D:
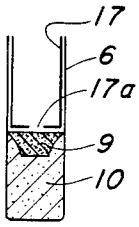
Figure 8E:
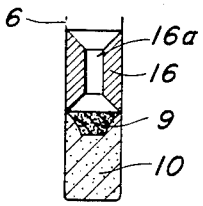
Figure 8F:
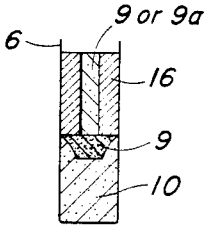
Figure 8G:
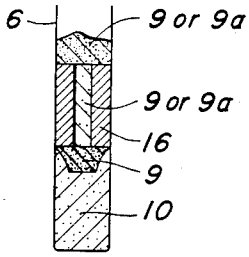
Figure 8H:
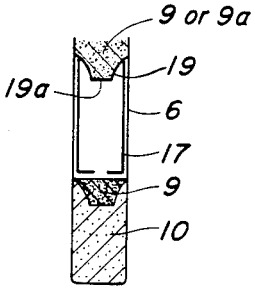
Figure 8I:
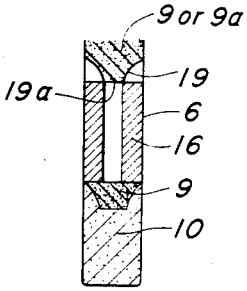

FIG. 7 A shows upper portion of a shell 6 with a plastic or metal cap 12A having an interference fit between the outer walls of the cap and the inner walls of the shell 6. A rupturable membrane is in the top of the cap and an open space 8 is below the rupturable membrane. FIG. 7 B shows the upper portion of a shell 6 with a plastic or metal cap 12B having an interference fit between inner walls of the cap and the outer walls of the shell. A rupturable membrane is in the top of the cap and an open space 8 is below the rupturable membrane. The interference fit between the cap and the shell walls is used to keep moisture out of the shell. Crimps to form a seal as shown in Yunan U.S. Pat. No. 4,426,933 may be used to improve moisture seals. Adhesives may also be used to improve moisture seals.

The rupturable membrane can be of the aforementioned plastic or thermosetting plastic materials or of a thin metal such as aluminum, brass or steel; aluminum is preferred. If the membrane is a metal it is about about 1–10 mils thick, preferably about 3–5 mil thick. If the membrane is a plastic, it is about 5–30 mils thick, preferably 8–12 mils thick. The plastic rupturable membrane may be flat and covers and seals the mouth of the shell. Other geometric configurations that facilites rupturing can be used on the membrane such as a cross, triangle, star and the like.

FIGS. 8 and 9 show shells containing explosives charges and may be inserted into the aforementioned connectors. These figures show possible combinations of explosive compositions and their schematic representations are not to scale.

FIG. 8 shows cross sections of various configurations of instantaneous detonators. FIG. 8 A shows a shell 6 containing the detonating base explosive charge 10 and a primer charge 9 imbedded in the base charge 10. FIG. 8 B shows the shell 6 containing the base charge 10 and the primer charge 9 pressed flatly over the base charge 10. Both types of primer and base charges will work in this invention. In the following figures only the embedded priming charge will be shown. FIG. 8 C shows two separate primer charges 9 and 9a in shell 6 pressed in contact with the base charge 10. Charge 9a is usually more sensitive than charge 9. Lead styphnate or one of the aforementioned mixtures of lead syphnate can be used for charge 9a.

FIG. 8 D shows a shell 6 with a capsule 17 having an orifice 17a positioned over the primer charge 9. The capsule is desired from a safety standpoint to press the primer charge in place.

FIG. 8 E shows a spacer 16 with an inner hole 16a needed for pressing the primer charge 9 over in the base charge 10. Spacer has an upper taper to direct the detonation from the open space to the primer. The lower taper is present for symmetry.

FIG. 8 F is the same as FIG. 8 E except that the spacer 16 is not tapered and the space inside the spacer is filled with loose or pressed primer powder 9 or 9a which is embedded in the base charge 10.

FIG. 8 G is the same as FIG. 8 F except that another primer charge 9 or 9a is positioned over the spacer 16. The primer 9b is shown as a loose charge but may also be a pressed charge.

FIG. 8 H contains a cup 19 with a rupturable bottom 19a positioned in the shell 6 and supported over the primer charge 9 by capsule 17. Loose or pressed primer charge 9 or 9a is in the cup.

FIG. 8 I is the same as FIG. 8 H except a spacer 16 is positioned between the primer charge 9 and the cap 19. Spacer 16 may be empty as shown in FIG. 8 I or filled as shown in FIG. 8F.

FIGS. 9 A through L show the cross section of delay detonators that can be used. In every case shell 6 contains a base charge 10 and an embedded primer charge 9. Delay timing is obtained by using delay charges which are essentially produced by gasless exothermic reaction mixture of solid oxidizing and reducing agents that burn at a controlled rate. Examples of such mixtures are boron-red lead, boron-red lead silicon, boron-red lead-dibasic lead phosphite, aluminum-cupric oxide, magnesium-barium peroxide, silicon-red lead and the like.

Figure 9A:
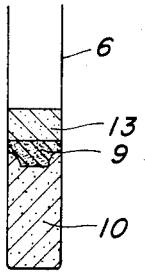
FIG. 9 A through L show cross sections of shells with different delayed explosives loadings that can be used to form the detonator device of this invention.

FIG. 9A shows a delay powder 13 pressed over primer charge 9.

Figure 9B:
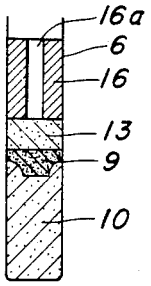

FIG. 9B shows an empty spacer 16 with a hollow center 16a pressed over delay charge 13.

Figure 9C:
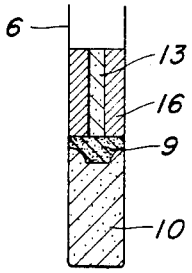

FIG. 9C shows delay powder 13 inside the hollow center spacer 16, commonly known as a carrier.

Figure 9D:
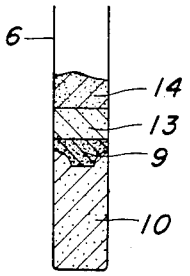
Figure 9E:
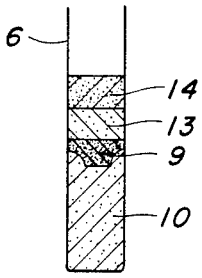

FIG. 9D shows a loosely loaded ignition charge 14 over pressed delay charge 13. The ignition charge 14 may be loose as shown or pressed as shown in FIG. 9E. Ignition charges are normally more sensitive to initiation than some delay powders, especially when pressed. Normally delay powders are pressed. The ignition charge 14 may be a primer charge which does not contribute to additional timing.

FIG. 9E is the same as 9D except the ignition charge 14 is pressed.

Figure 9F:
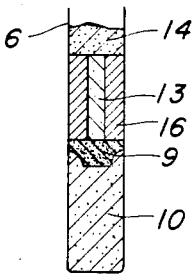

FIG. 9F shows an ignition charge 14 over delay carrier 16 with delay powder 13 in spacer 16. Ignition charge 14 may be pressed (not shown).

Figure 9G:
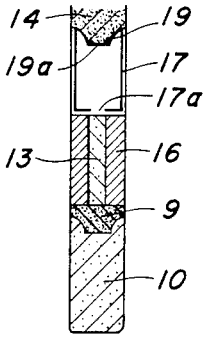

FIG. 9G is the same as FIG. 9C, but also shows ignition powder 14 in cup 19 supported by capsule 17 which has a rupturable membrane 19a.

Figure 9H:
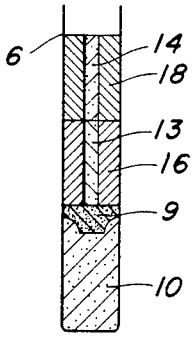

FIG. 9H is the same as FIG. 9C, but also shows another carrier 18 loaded with either priming powder 14 positioned over spacer 16 with delay charge 13.

Figure 9I:
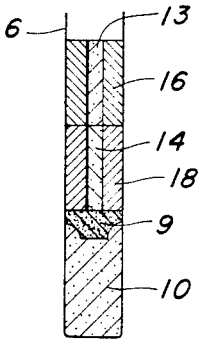

FIG. 9I is the same as FIG. 9H, except that the carriers are reversed. Top carrier 16 contains delay powder 13.

Figure 9J:
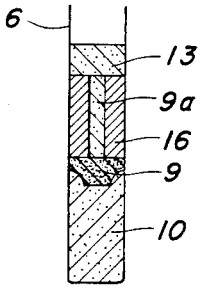

FIG. 9J has delay powder 13 pressed over carrier 16 which contains a primer powder 9a.

Figure 9K:
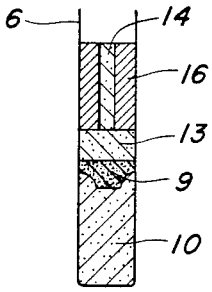

FIG. 9K is the same as FIG. 9B, but shows carrier 16 containing ignition powder 14 pressed over delay powder 13.

FIG. 10A shows an explosive charge 20 in a flexible container having a LEDC cord 3a wrapped around the container and positioned in plastic holder 12 having a fixed slot positioned over the open end of the shell 6 of the detonator. The detonator contains a detonating base charge 10 and a priming charge 9 positioned over the base charge. A spacer 16 with its center filled with a primer charge 9a is positioned over the primer charge 9. A delay powder 13 is positioned over the spacer. As shown in FIG. 3, the detonator has rupturable membranes and open space.

FIG. 10B shows a block explosive charge 21 containing a detonator. LEDC 3a is positioned in the center cavity of the charge 21 and attached to the plastic holder 12 of the detonator positioned over the open end of the shell 6 of the detonator. The detonator contains a base charge 10, a priming charge 9 positioned adjacent to the base charge. There is a open space between the rupturable membrane 7 and the priming charge 9.

Figure 9L:
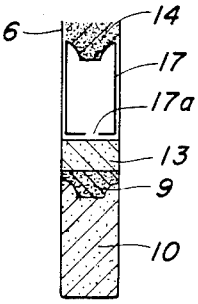

FIG. 9L is the same as FIG. 9G, except delay powder 13 is pressed over primer charge 9.

The following examples illustrate the invention.

EXAMPLE 1

Aluminum shells 1.67 inches long with 0.003 inch thin bottom were loaded with 8 grains of a base explosive of pentaerythritol tetranitrate (PETN) and pressed with a pin to form a cavity and then 3.6 grains of a primer of dextrated lead azide was loaded and pressed with a flat pin. The space between the lead azide and the open end of the shell was 1.2 inches. The shell was inserted open end first, into a cylindrical plastic with a closed membrane at the other end (see FIG. 3). The inner diameter of the cylindrical plastic body next to the membrane formed an interference fit against the outside walls of the cylindrical shell. The plastic body loaded with the shell was subjected to hydraulic pressure of 10 psi for 8 hours. Upon examination the shell and its contents were found to be dry.

A detonator was made as shown in FIG. 1, by placing a shell prepared as above in a plastic body and a LEDC 2.2 grain/foot (1.7 grain/foot PETN basis) was placed over the sealing membrane of the shell as a trunkline. The LEDC is described in Yunan U.S. Pat. No. 4,232,606 issued Nov. 11. 1980. Two down lines of the same cord were placed against the bottom of the shell forming a "U" shaped configuration after closing the latch. The trunkline cord that was positioned against the thin membrane was fired and two downlines were initiated instantly by the detonator. The same detonator was made as above except a shell was used that had a 3 inch space between the cap with a sealing membrane and the sensitive explosive. This detonator also fired instantly.

The above shows that reliable instantaneous detonators can be made for use with LEDC that do not contain a percussion element.

EXAMPLE 2

Four aluminum shells described in Example 1 were each loaded with 8 grains of PETN and 3.6 of dextrinated lead azide priming charge as in Example 1 and each of the shells was loaded and pressed with a different level of a delay powder of boron/red lead/silicon (B/RL/S). Each shell was covered with a plastic connector to form a delay detonator as shown in FIG. 9A. A LEDC was connected to each shell and each shell was fired and timed. The results of the test are shown in the following table:

| Delay Powder (B/RL/S) (grains) | Open space (inches) | Ave. Timing (milliseconds) |
|---|---|---|
| 4 | 17/16 | 76 |

-continued

| Delay Powder (B/RL/S) (grains) | Open space (inches) | Ave. Timing (milliseconds) |
|---|---|---|
| 17 | 13/16 | 234 |
| 32 | ½ | 422 |
| 42 | 11/32 | 553 |

The above shows that delayed detonations can be obtained with the pressed delay powders.

EXAMPLE 3

An aluminum shell described in Example 1 was charged with a PETN and dextrinated lead azide load as in Example 1 and 3.0 grains of Type 15 red lead/silicon delay powder was pressed at 250 pounds over the lead azide load with a flat pin and 4.2 grains of Type 11 (B/RL/Si) loose ignition powder was loaded over the pressed delay powder which partially filled the open space in the shell. The shell was sealed by a plastic cap with rupturable membrane. An LEDC containing 3.2 grain/foot (2.4 grain /foot PETN basis) was used to fire the detonators. A series of detonators of the same construction were fired and the average fire time delay was 150 milliseconds with 7 milliseconds standard deviation. It was conclude that good timing accuracy is possible with this type of detonator.

EXAMPLE 4

An aluminum shell described in Example 1 was charged with a PETN and lead azide as in Example 1 and a metallic carrier loaded with a delay powder was pressed over the lead azide charge (see FIG. 9C). There was a 1 inch open space between the metallic carrier and the rupturable membrane covering of the shell. Two additional detonators were prepared as above except the open space between the membrane and the metallic carrier was ⅛ inch and ¼ inch, respectively. An additional detonator was prepared as above with a 1 inch open space except loose delay powder (B/RL/Si) was placed over the metallic carrier (see FIG. 9F). The detonators were fired using the LEDC described in Example 1. The results are as follows:

| Nominal Delay (milliseconds) | Open Space (inches) | Loose Delay Powder | Number Shot Per Total Tested |
|---|---|---|---|
| 125 | 1 | None | 0/2 |
| 125 | 1 | Yes(4 grain) | 2/2 |
| 175 | ⅛ | None | 7/7 |
| 175 | ¼ | None | 6/11 |

It is concluded that delay carriers may reliably be initiated directly from an LEDC and through a membrane at a spacing of 1 inch with the use of loose delay powder and at a spacing of ⅛ inch without loose delay powder.

EXAMPLE 5

Instantaneous detonators were prepared by loading aluminum shell with a primer and and explosive charge as in Example 1 with different lengths of open space and a plastic LEDC holder with a rupturable membrane was positioned over the open end of the shell to form a detonator as shown in FIG. 3. The detonators were then fired using the LEDC described in Example 3. The results are shown below:

| Open space (inches) | Average time (inches) (milliseconds) |
|---|---|
| 6 | 1.2 |
| 10 | 1.4 |
| 11 | 1.4 |
| 12 | failed |

It is concluded that a reliable initiation up to an 11 inch gap is possible with no indication of weakening of the propagation flame from the detonating cord.

I claim:

1. A non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell and (d) means for holding low energy detonating cord (LEDC) positioned in abutting relationship to the membrane;

whereby on detonation of the LEDC the membrane is ruptured and the priming charge is initiated which in turn initiates the detonating explosive.

2. The detonator of claim 1 in which the open volume is about 1/32–11 inches in length.

3. The detonator of claim 1 in which the priming charge contains one member selected from the group consisting of lead azide, lead styphnate, diazodinitrophenol, mercury fulminate, nitromannite and mixtures thereof.

4. The detonator of claim 3 in which the membrane is a thin metal.

5. The detonator of claim 4 in which the membrane is aluminum.

6. The detonator of claim 3 in which the membrane is a plastic.

7. The detonator of claim 6 in which the membrane is polypropylene.

8. The detonator of claim 3 in which the base charge is pentaerythritol tetranitrate.

9. The detonator of claim 3 in the priming charge is lead azide.

10. A non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell and (d) means for holding low energy detonating cord (LEDC) positioned in abutting relationship to the membrane;

whereby on detonation of the LEDC the membrane is ruptured and the priming charge is initiated which in turn initiates the detonating explosive and wherein a spacer is placed over the priming charge.

11. The detonator of claim 1 in which the means for holding the LEDC is a plastic cap having a fixed slot positioned over the end of the shell sealed with the membrane.

12. The detonator of claim 1 in which the means for holding the LEDC is a plastic cap having a slotted hinged top and is positioned over the end of the shell sealed with the membrane.

13. A non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell, (d) a first plastic cap having a fixed slot positioned over the end of the shell sealed with the membrane for holding low energy detonating cord (LEDC) positioned in abutting relationship to the membrane; and (e) a second plastic cap for holding LEDC being positioned on the closed end of the shell opposite the first plastic cap having a fixed top, whereby on detonation of the LEDC the membrane is ruptured and the priming charge is initiated which in turn initiates the detonating explosive.

14. A non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell, (d) a first plastic cap having a fixed slot positioned over the end of the shell sealed with the membrane for holding low energy detonating cord (LEDC) positioned in abutting relationship to the membrane; and (e) a second plastic cap for holding LEDC positioned on the closed end of the shell opposite the first plastic cap having a hinged top;

whereby on detonation of the LEDC the membrane is ruptured and the priming charge is initiated which in turn initiates the detonating explosive.

15. The detonator of claim 2 having a priming charge of lead azide, a base charge of penaerythritol tetranitrate, a membrane of polypropylene and the means for holding the LEDC is a slotted plastic cap over the membrane of the shell.

16. A non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a delay charge of an exothermic burning composition positioned over the priming charge;

(d) a rupturable membrane that seals the top end of the shell and forms an open volume between the priming charge and the top end of the tubular shell and (d) means for holding low energy detonating cord (LEDC) positioned in abutting relationship to the membrane;

whereby on detonation of the LEDC the membrane is ruptured and the delay charge is initiated which initiates the priming charge which in turn initiates the detonating explosive.

17. The detonator of claim 16 in which the open volume is about 1/32–11 inches in length.

18. The detonator of claim 16 in which the delay charge is from the following group boron-red lead, boron-red lead silicon, boron-red lead-dibasic lead phosphite, aluminum-cupric oxide, magesium-barium peroxide and silicon-red lead.

19. An explosive assembly comprising at least one detonator, low energy detonating cord (LEDC) attached to the detonator and an explosive charge in which the detonator is positioned; wherein the detonator comprises a non-electric detonator device of a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a rupturable membrane that seals the top end of the shell and forms an open volume between the priming charge and the top end of the tubular shell, and (d) means for holding LEDC positioned in abutting relationship to the membrane;

whereby on detonation of the LEDC the membrane is ruptured and the priming charge is initiated which in turn initiates the detonating explosive.

20. An explosive assembly comprising at least one detonator low energy detonating cord (LEDC) attached to the detonator and an explosive charge in which the detonator is positioned; wherein the non-electric detonator device comprising a tubular shell closed at its bottom end and containing (a) at least one base charge of a detonating explosive composition positioned in the bottom of the shell, (b) a priming charge of a heat sensitive detonating explosive composition adjacent to the base charge that does not fill the shell, (c) a delay charge of an exothermic burning composition positioned over the priming charge;

(d) a rupturable membrane that seals the top end of the shell and forms an open volume between the priming charge and the top end of the tubular shell and (e) means for holding low energy detonating cord (LEDC) positioned in abutting relationship to the membrane;

whereby on detonation of the LEDC the membrane is ruptured and the delay charge is initiated which initiates the priming charge which in turn initiates the detonating explosive.

* * * * *